United States Patent [19]

Greene

[11] 3,942,444

[45] Mar. 9, 1976

[54] VARIABLE ENERGY EXPLOSIVE DRIVER

[75] Inventor: Gordon A. Greene, Ridgecrest, Calif.

[73] Assignee: The United States of America as represented by the Secretary of the Navy, Washington, D.C.

[22] Filed: Sept. 3, 1974

[21] Appl. No.: 503,017

[52] U.S. Cl. ..... 102/70 R; 102/85.2; 89/1 B

[51] Int. Cl.[2] ..... C06C 5/06

[58] Field of Search ..... 102/27, 70, 76, 85.2; 89/1 B

[56] References Cited

UNITED STATES PATENTS

| | | | |
|---|---|---|---|
| 3,597,870 | 8/1971 | Block | 42/42 |
| 3,618,527 | 11/1971 | Kilmer | 102/76 |

FOREIGN PATENTS OR APPLICATIONS

| | | | |
|---|---|---|---|
| 851,313 | 7/1952 | Germany | 102/27 F |

*Primary Examiner*—Verlin R. Pendegrass
*Attorney, Agent, or Firm*—R. S. Sciascia; Roy Miller

[57] ABSTRACT

An apparatus for providing a variable explosive energy source. The apparatus has an outer annular body with a wall containing a plurality of radial explosive chambers. A rotatable circular body positioned within the annular body and concentric with its axis allows 360° mechanical rotation to bring an explosive train in intimate contact with a desired number of the explosive chambers. A squib device located within the circular body is electrically actuated to ignite an explosive train causing detonation of a predetermined number of the explosive chambers which are in contact with the explosive train.

1 Claim, 2 Drawing Figures

VARIABLE ENERGY EXPLOSIVE DRIVER

BACKGROUND OF THE INVENTION

The present invention relates in general to explosive energy devices and more particularly concerns a novel energy device that can produce a predetermined amount of available energy for use in gas generators or the like, that is small in form, and is easy and inexpensive to fabricate in large or small quantities.

Due to the demand in the past few years for explosive warheads and explosive weapons to operate more efficiently against a variety of targets it has been necessary in some cases to provide initiating devices that have more flexibility than prior igniters. For example, it may be desirable in many cases to sense a parameter or parameters of a warhead such as its speed and cause a change in the initiation pattern of the explosive in the warhead. Another situation where a variable explosive energy source is desirable is with fuel air explosive devices that are designed to operate at high speeds. A common expedient in this type of device is to drop fuel loaded canisters from an aircraft. The fuel in the canisters is dispersed into a large fuel air cloud a predetermined distance above ground in the target area and is detonated whenever the fuel air mixture reaches explosive proportions. By enclosing the apparatus of the disclosed variable energy source in an enclosed chamber, a gas generator can be formed for ejecting a cloud detonator or detonators into the explosive cloud formed by a fuel air explosive weapon with a force that is dependent upon the free fall velocity of the weapon as it falls toward the ground target.

Prior art attempts to solve the need for a variable energy source have involved the use of multiple detonators designed to fire simultaneously when initiated by means of electrical circuitry. Other devices have used a number of different explosive charges having weighted explosive values. In operation, a charge is chosen that has the desired gas generating volume and only it is electrically detonated. These types of devices are necessarily complex and require dependance on various configurations of electrical switching techniques to properly detonate the charge or charges. This increased complexity can affect the reliability of operation of a system and increase its cost.

SUMMARY OF THE INVENTION

A feature of the invention is to provide a variable energy explosive apparatus for use as a gas generator or to provide an apparatus that can be used as a rotary explosive switch.

The apparatus is formed of a cylindrical inner portion that is mechanically rotatable within an annular body. The cylindrical portion has formed on its circumference a number of explosive trains that are in close contact with radial apertures or holes filled with explosive. A squib or other detonating means positioned within the cylindrical portion is electrically actuated to ignite an explosive train to detonate a predetermined number of the radial located explosive charges dependent on the position of the rotary cylindrical inner portion.

DESCRIPTION OF THE PREFERRED EMBODIMENT

Figure 1:
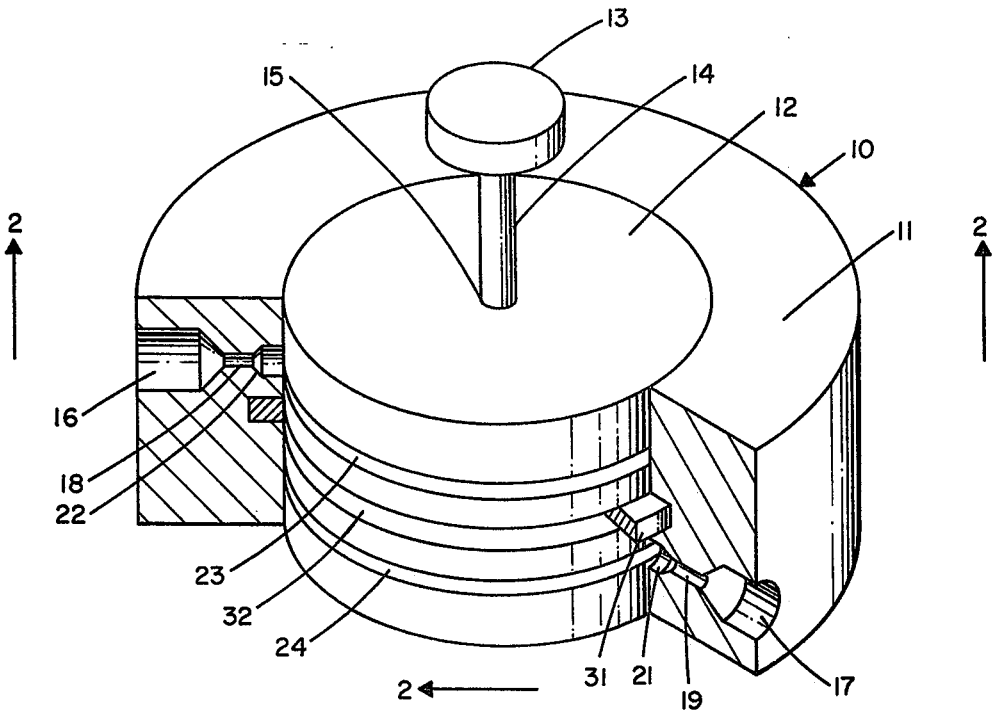
FIG. 1 is a perspective view of the variable energy explosive apparatus.

Referring now more particularly to the drawings and with reference to FIG. 1 which illustrates a preferred embodiment of the unique variable energy apparatus as indicated generally by the number 10 there is shown an annular outer body member 11 having a substantial wall thickness to form the outermost portion of the variable explosive energy apparatus. A centrally located portion 12 of generally cylindrical shape having its axis concentric with the axis of annular member 11 is located for rotative movement within the annular body member. A circumferential groove 32 formed in the surface of cylindrical member 12 and positioned midway between its two end surfaces forms a means to hold the two members in position with respect to one another and to allow rotation of member 12 through 360°. A spring like metal ring 31 formed in the inner wall of member 11 extends outwardly from the wall surface a sufficient amount around its inner circumferential surface to permit a portion to extend in engagement with groove 32 to effectively lock the two members together. Ring 31 permits free rotation whenever sufficient force is exerted on knob 13, which transmits this force via shaft 14 to member 12. The end of shaft 14 is located concentric with member 12 at point 15. When no force is exerted on knob 13, sufficient contact friction exists between the surface of ring 13 and the inner surface portions of circumferential groove 32 to prevent rotary movement.

Formed in the exterior wall surface of annular member 11 is a plurality of explosive holding holes or apertures 16 and 17, respectively, extending only part of the way through the wall. These have a substantially larger diameter than the communicating passageway 18 and 19, respectively, which extends completely through the wall of annular member 11. As shown in the Figures of the drawings the explosive holding apertures may be formed in two tiers extending around the circumference of member 11. An enlarged portion 21, 22 is formed in the inner surface of member 11 to allow complete coverage on either side of explosive trail 23 and 24, respectively.

Grooves 23 and 24 are formed in the exterior surface so that they extend a predetermined distance around the circumference of member 12 in order to be in intimate contact with any desired number of explosive holes such as 16 and 17, respectively. The grooves may extend any desired angular distance along the surface of member 12 in order that a segment of the groove can come in contact with a given number of explosive holes such as 16 and 17.

Figure 2:
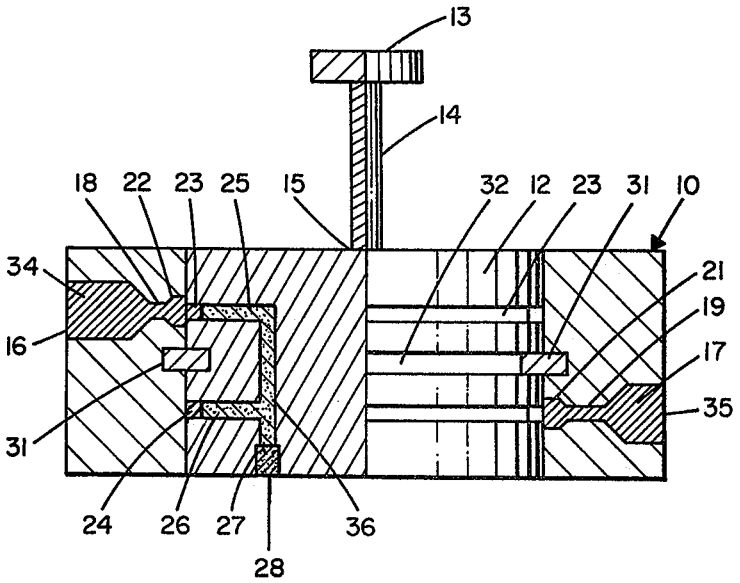
FIG. 2 is a diagrammatic sectional view taken in the direction of the arrows 2—2 of FIG. 1 showing the structural interrelationship between elements of the explosive apparatus.

The inner communicating passageways 25 and 26 within body member 12 are best shown with reference to FIG. 2. At the bottom surface of a common passageway 36 there is positioned an electrically actuated igniter 27 having electrical leads 28 attached to an energy source not shown. An explosive material is positioned in passageways 26, 25 and 36. Additional explosive material is placed within the channels or trails formed by grooves 23 and 24, respectively. Explosive charges are formed in each explosive hole such as 16 and 17 and additional explosive material fills the passageways 18, 19 and enlarged portions 21 and 22. This structural configuration permits an explosive trail to extend to each external explosive hole depending upon the relationship of annular body member 11 and inner body member 12.

In operation, the knob 13 is rotated a desired amount to bring the grooves 23, 24 in intimate contact with a single or a plurality of explosive holes at enlarged portions 21 and 22. Squib 27 may then be electrically fired causing a detonation wave front to travel through passageways 25 and 26 via common passageway 36. Because of the enlarged portions 21 and 22 and their closeness of contact to the explosive formed in grooves 23 and 24 the detonation front will continue on to ignite explosive 34 and 35 within holes 16 and 17, respectively. This permits firing of the two charges simultaneously, thus allowing the generation of an explosive force equal to the two charges. If environmental conditions require more explosive force, additional explosive holes or apertures may be brought in contact with the explosive trains to ignite a plurality of holes and thus increase proportionately the force of the explosive.

It is to be understood that although the explosive 34 is shown as a short plug it could easily be extended linearly to a remote distance from apparatus 10 by means of a thicker wall portion or by means of an explosive trail. This allows the apparatus to be used in much the same way as a rotary electrical switch to supply explosive detonating fronts to a plurality of positions from a single initiation point.

Another use of the unique variable energy explosive apparatus could be a gas generator that allows a predetermined gas pressure to be generated. This can be accomplished by allowing a multiplicity of explosive holes to fire simultaneously while apparatus 10 is in a closed chamber having a single or multiplicity of exits.

Although the preferred embodiment has been described, it will be understood that within the purview of this invention various changes may be made in the form, details, proportion and arrangement of parts, the combination thereof and mode of operation, which generally stated consists in a device capable of carrying out the objects set forth, as disclosed and defined in the appended claims.

What is claimed is:

1. An explosive apparatus for supplying a variable source of energy, comprising:

a first member having an annular shape, rectangular in section, and concentric about a longitudinal axis, and said first member defining a plurality of round chambers therein, each chamber having two opposite ends of increased diameter joined by a central corridor of reduced diameter, said chambers penetrating said annular member, being aligned radially and disposed about the circumference of said annular member in two 180° sectors, the chambers in either of said sectors being longitudinally displaced relative to the chambers in the other sector, said chambers thereby defining two parallel spaced apart planes perpendicular to said longitudinal axis, said annular member also having a groove around the inner circumference, said groove being longitudinally disposed parallel to and between said planes;

a second member having a right circular cylindrical shape, concentrically and coextensively disposed within said first member and having a groove on the outer circumference of said second member, aligned longitudinally with said inner circumferential groove in said first member;

said second member further defining an internal explosive retaining passage leading from a single ignition source, parallel to and spaced from said longitudinal axis, and branching radially to reach the curved surface of said cylindrical second member at two locations which are each coplanar with one of said parallel planes, and continuing in two oppositely directed semicircular channels around said curved surface of said second member, each channel lying in one of said parallel planes;

a locking ring occupying said inner circumferential groove in said first member and said outer circumferential groove in said second member, said ring being formed to frictionally contact said first and second members for constraining said second member within said first member to relative frictional rotation;

an electrically ignited squib fixedly secured to said second member forming said single ignition source;

explosive material filling and retained in said chambers within said first member, and in said explosive retaining passages and channels within said second member;

means for rotating said second member relative to said first member;

for enabling said explosive retained in said channels on said second member to achieve intimate contact with said explosive retained in any number of said chambers in said first member by rotation of said second member relative to said first member thereby selectively arming a predetermined number of passages for substantially simultaneous detonation by said squib resulting in a single device capable of a range of explosive outputs.

* * * * *